US005138775A

United States Patent [19]

Chu

[11] Patent Number: 5,138,775

[45] Date of Patent: Aug. 18, 1992

[54] VENTILATED SHOES

[76] Inventor: Hui-Cheng Chu, No. 42, Sec. 1, Hwan-Ho South Rd., Taipei, Taiwan

[21] Appl. No.: 784,638

[22] Filed: Oct. 28, 1991

Related U.S. Application Data

[63] Continuation of Ser. No. 549,425, Jul. 6, 1990, abandoned, which is a continuation-in-part of Ser. No. 313,511, Feb. 22, 1989, abandoned.

[51] Int. Cl.[5] ..... A43B 7/06

[52] U.S. Cl. ..... 36/3 B; 36/3 R

[58] Field of Search ..... 36/3 R, 3 A, 3 B, 24.5

[56] References Cited

U.S. PATENT DOCUMENTS

| | | | |
|---|---|---|---|
| 1,223,042 | 4/1917 | Devlin | 36/3 A |
| 2,025,647 | 12/1935 | Daly et al. | 36/24.5 |
| 2,441,879 | 4/1948 | Gantt | 36/3 R |
| 2,558,973 | 7/1951 | Meaker | 36/3 B |
| 2,741,038 | 4/1956 | Eliassen | 36/3 R |
| 3,475,836 | 11/1969 | Brahm | 36/3 B |
| 3,973,336 | 8/1976 | Ahn | 36/3 B |
| 4,100,685 | 7/1978 | Dassler | 36/3 B |
| 4,602,441 | 7/1986 | El Sakkaf | 36/3 B |

FOREIGN PATENT DOCUMENTS

| | | | |
|---|---|---|---|
| 266286 | 2/1965 | Australia | 36/24.5 |
| 1598123 | 8/1970 | France | 36/3 B |
| 2558044 | 7/1985 | France | 36/3 B |
| 2189679 | 11/1987 | United Kingdom | 36/3 B |

*Primary Examiner*—Steven N. Meyers
*Attorney, Agent, or Firm*—Larson and Taylor

[57] ABSTRACT

A shoe having a structure to supply fresh air to the interior of the shoe. The structure to supply fresh air comprising a resilient bulging pad in the heel portion of the shoe and including one-way valves to direct the air flow.

18 Claims, 8 Drawing Sheets

VENTILATED SHOES

CROSS REFERENCE TO RELATED APPLICATIONS

This application is a continuation of application Ser. No. 07/549,425 filed Jul. 6, 1990, now abandoned, which is a continuation-in-part of application Ser. No. 07/313,511 filed Feb. 22, 1989, now abandoned.

BACKGROUND OF THE INVENTION

It is well known that heat and perspiration are normally generated around the toe area in shoes. This area tends to remain damp and is not easily ventilated because of the shoe construction. Therefore, after being worn for a period of time, the interior portion of the shoe will generate a bad smell and the moisture will attract and breed foot diseases. The situation will become more serious especially when wearing leisure type shoes and sneakers. Even if some holes are punched at the arch portion of the shoe, the situation is not improved very much. Nevertheless, there are some improved constructions of conventional shoes that have been designed to overcome the above mentioned drawbacks. Some of the improvements, however, are nothing more than the installation of an elastic pad in the upper portion of the shoe heel and building some ventilation channels in order to create an air circulation. This type of improvement is disclosed in U.S. Pat. Nos. 964,482 and 2,003,646. Other improvements include the installation of an air pump in the heel of the shoe or spaced apart resilient soles with air channels therebetween and orifices in the inner sole in communication with the air channels, such as disclosed in U.S. Pat. Nos. 2,441,879 and 4,468,869, respectively. Although the improved interior structures of these prior art shoes actually do have an effect of forcing ventilation of the shoe, the wearers have experienced certain drawbacks or the air pumping structure has certain deficiencies described hereinafter.

It is well known that a comfortable wearing of shoes generally demands a suitable enclosure of the foot, i.e. the foot can not have an excessive free space that permits movement. From the prior cited patents it is obvious that the elastic pad for pressing air out of the air cell is installed in the upper portion of the shoe heel and bulges out of its surface. In an attempt to get enough space for an air cell, it is necessary to have a large space for the elastic pad to move, or the ventilation effects will be greatly reduced. There is now a dilemma as to whether to have a comfortable fit or to have a greater compressible amount of air space. This means that when the wearer's foot is lifted from the ground, the depressing force on the elastic pad is eliminated and the pad is restored to its original position by the resiliency of the material of the pad. The elasticity for restoring the shape will make the wearer's heel move from the shoe heel for a certain distance and make the wearer have an uncomfortable feeling of a loose shoe. On the other hand, it is possible to solve the problem by permitting only a small movement between the wearer's heel and the shoe heel. This arrangement, however, will cause an insufficient compression space for the air cell.

There are also problems in those shoes that provide an air pump that is activated by the walking of the wearer. These problems usually manifest themselves over the life of the shoe. In some cases, the ventilation orifices and valves that form a part of the pumping apparatus, become clogged with debris, permit moisture to enter the pumping space, or become inoperative because of the valve construction. In addition, the prior art shoes generally require the outer or bottom sole to be of the same material, which is usually a molded material, as the heel. This construction greatly limits the design freedom of the shoes.

SUMMARY OF THE INVENTION

Accordingly, this invention provides a novel construction for solving the above mentioned problems. The detailed content of this invention will become more readily apparent from a consideration of the following description and attached drawing.

DETAILED DESCRIPTION OF THE PREFERRED EMBODIMENTS

Figure 1:
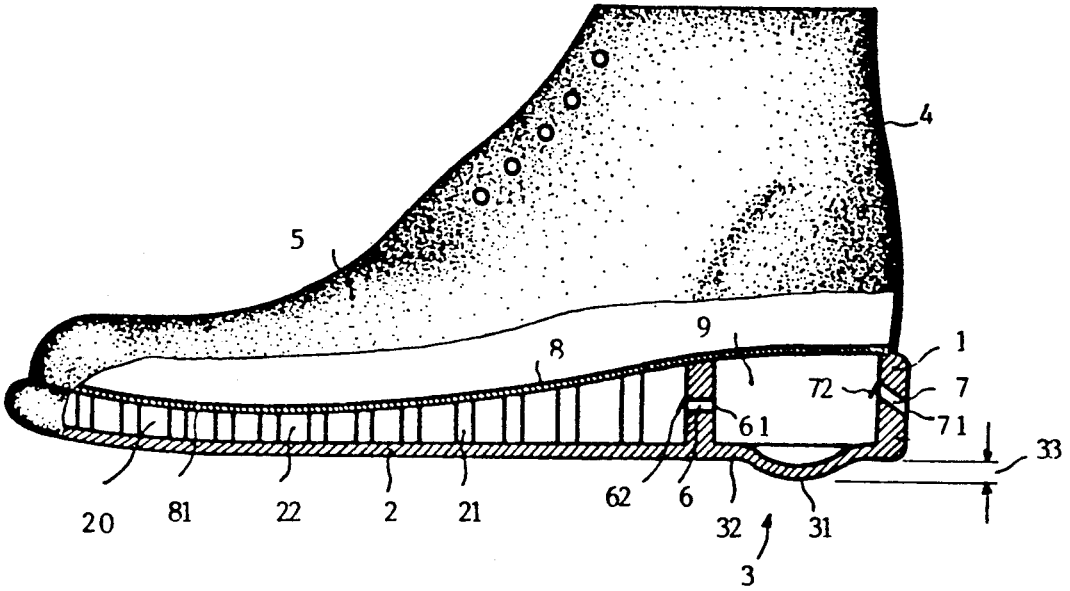
FIG. 1 is a side elevational view of a shoe according to a first embodiment of the present invention with parts removed to illustrate in cross section certain aspects of the construction of the shoe.
Figure 2:
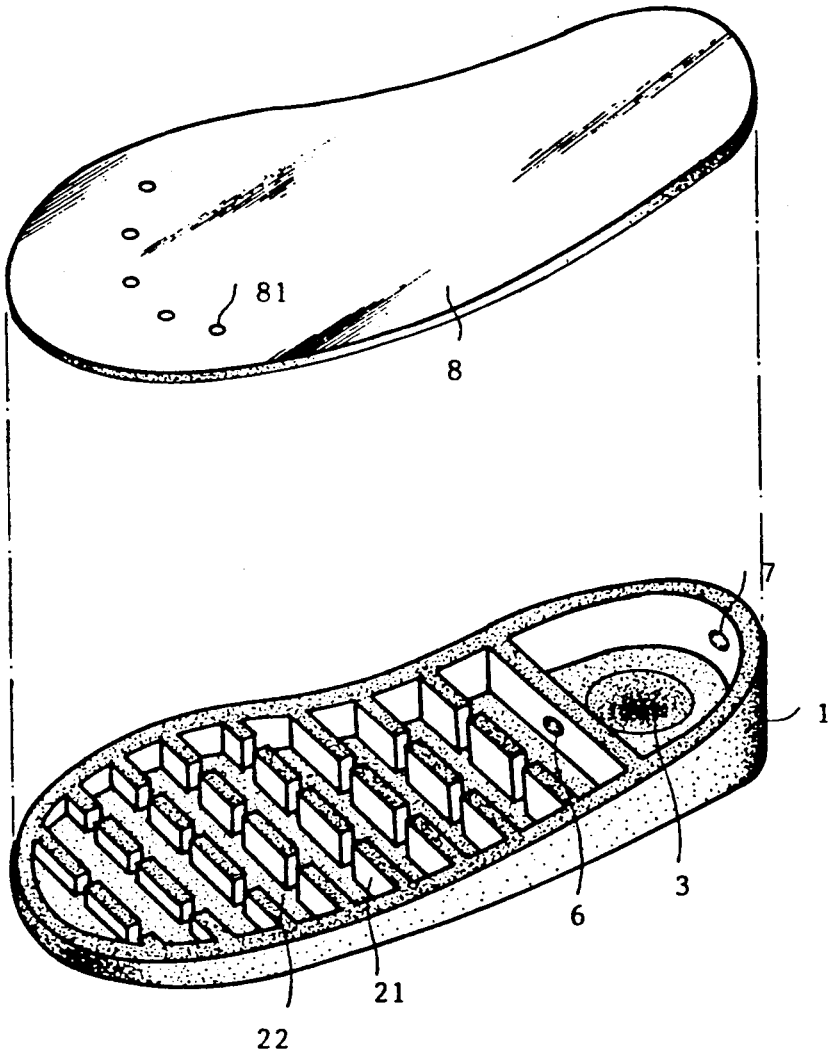
FIG. 2 is an exploded, perspective view of the shoe depicted in FIG. 1.

With reference now to the figures in which like numerals depict like elements throughout the several views, and in particular with reference to FIGS. 1 and 2, a shoe 5 in accordance with a first embodiment of the present invention is depicted. Shoe 5 includes a conventional upper portion 4 and a sole portion comprised of a shoe heel 1 and a sole 2 manufactured by a conventional whole body molding process. A bulging pad 3, made of resilient material and which is round in plan view, is located on, and is resiliently mounted to, the bottom of heel 1, and several, spaced apart middle-sole supporters 21 are mounted on the upper surface of sole 2 between it and a middle sole 8. Middle sole 8, in turn, is mounted to upper portion 4 and the top of heel 1. Heel 1 has a fully enclosed, sealed hollow cavity 9 located therein which provides an air cell. Because supporters 21 are mutually spaced apart and space sole 2 and middle sole 8 apart, a jacket space 20 with a plurality of interconnected channels 22 (see FIG. 2) is created therebetween. Jacket space 20 and its channels 22 are in fluid communication with heel cavity 9 through a channel 61 completely through the front wall (as depicted in FIG. 1) of heel 1.

Figure 3:
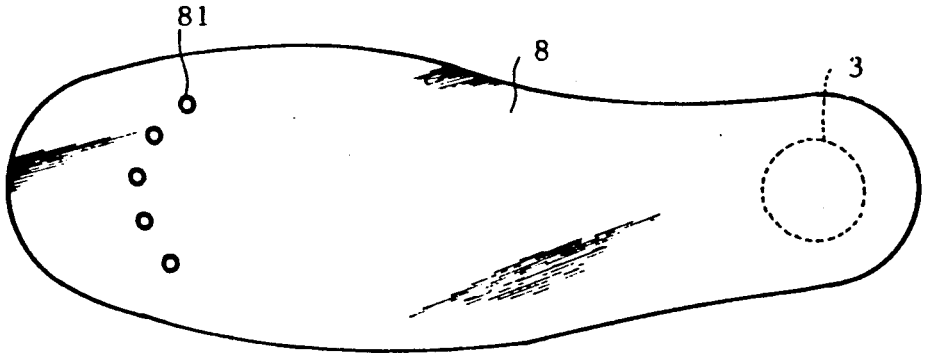
FIG. 3 is a top plan view of the shoe depicted in FIG. 1.
Figure 4:
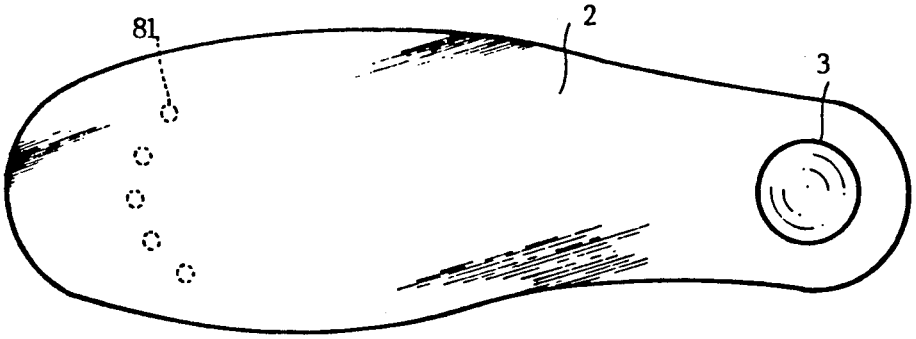
FIG. 4 is a bottom plan view of the shoe depicted in FIG. 1.

The back wall (as depicted in FIG. 1) of heel 1 is provided with a forwardly upwardly inclined orifice or channel 71 completely therethrough. The channel 71 places heel cavity 9 in fluid communication with the environment outside thereof. Because channel 71 is inclined upwardly into heel cavity 9, it provides a means for preventing, or at least limiting, the entrance of contaminents such as dirt, debris, and water into cavity 9. Valve membranes 62 and 72 are hinged and mounted on, respectively, the forward surfaces of the forward and rearward sides of heel 1 over the openings of channels 61 and 71. Since membranes 62 and 72 are attached to channels 61 and 71 in the opposite direction, an inlet check valve 6 and an outlet check valve 7 are thus formed. In addition, as depicted in FIGS. 3 and 4, middle sole 8 is provided with a plurality of air outlet holes or orifices 81 located in the toe portion of shoe 5. Orifices 81 thus provide a fluid communication between the interior of shoe 5 with jacket space 20.

Figure 5:
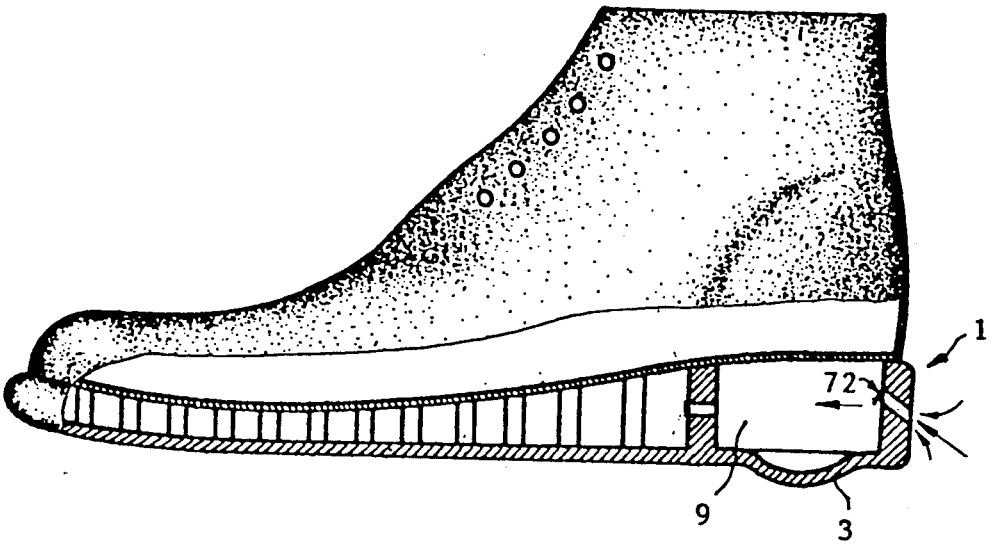
FIG. 5 is a side elevational view of the shoe depicted before the bulging pad, which forms a part of the pumping assembly, is compressed.
Figure 6:
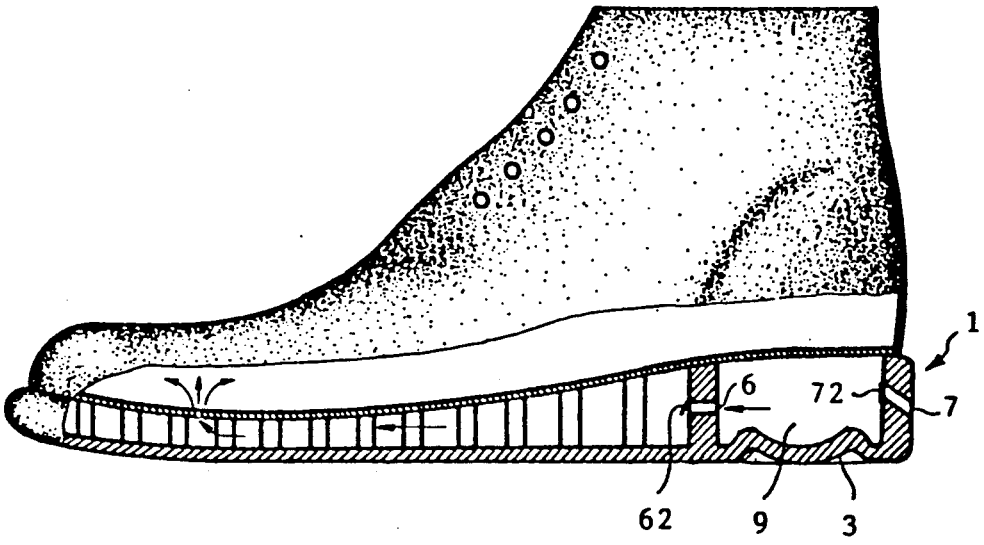
FIG. 6 is a side elevational view of the shoe depicted with the bulging pad in compression.

As depicted in FIGS. 5 and 6, bulging pad 3, positioned beneath heel 1, is deformed or bent inwardly from the pressure of the wearer's weight when walking with shoes 5. Consequently, the volume of air cell or cavity 9 is reduced and the air therein pressurized, which opens membrane 62 on outlet check valve 6 and permits the compressed air to be expelled into air channels 22. Membrane 72 is forced closed by the air pressure and prevents the pressurized air from escaping outside heel cavity 9 since the action of inlet check valve 7 is contrary to that of outlet check valve 6. In addition, middle-sole supporters 21 are separated at a constant distance (see FIG. 2) and channels between supporters 21 are in fluid communication in all directions. Thus, channels 21 are filled with compressed air expelled from air cell 9. Said compressed air is then admitted to the toe or other portions of middle sole 8 and dispersed to the interior portion of shoe 5. When the pressure on bulging pad 3 is removed when the wearer's heel is lifted off the ground, such as when walking, pad 3 is restored to its original shape by the resiliency of the material, and the volume of air cell or cavity 9 is gradually increased. Bulging pad 3 thus creates a vacuum or suction in cavity 9 and fresh air enters it via inlet check valve 7 past valve membrane 72 (FIG. 5). The vacuum in cavity 9 also seals membrane 62 of check valve 6 against the forward wall of heel 1, thus closing outlet check valve 7. Thus the series of circulating air procedures is now completed.

The inward volume of cavity 9 caused by the deformation of pad 3 by the pressure of the wearer's weight depends on the bulging volume 33 (FIG. 1). The amount of bulging volume 33 is between the plate lift 32 of heel 1 and the bulging point 31 located on the middle portion of the bulging pad 3. Bulging pad 3 has a cross-sectional shape of gradually inclining from bulging point 31 to its peripheral edges. This design not only makes the deformation of the bulging pad smoother and more stable, but also helps to prevent the bulging pad from catching during walking.

The present invention thus provides a bulging pad 3 beneath heel 1 for the purpose of eliminating the contradiction of practicability and functionality inherent in the prior art. Because bulging pad 3 is not installed in the interior portion of the shoe, the wearer's heel keeps an adequate contact with the shoe heel while the pressure of bulging pad 3 is decreased and the pad restored to its original shape. The best results is therefore obtained since the wearer not only avoids an uncomfortable feeling of a pair of loose shoes, but also gets sufficient air for interior ventilation.

As described heretofore, this embodiment of the invention takes a bulging pad positioned on the bottom of a shoe heel as a principle element, and together with accompanying check valves and air channels provide a pressurized or forced air circulation inside a shoe. The invention thus provides the wearer a comfortable feeling when they are walking.

Figure 7:
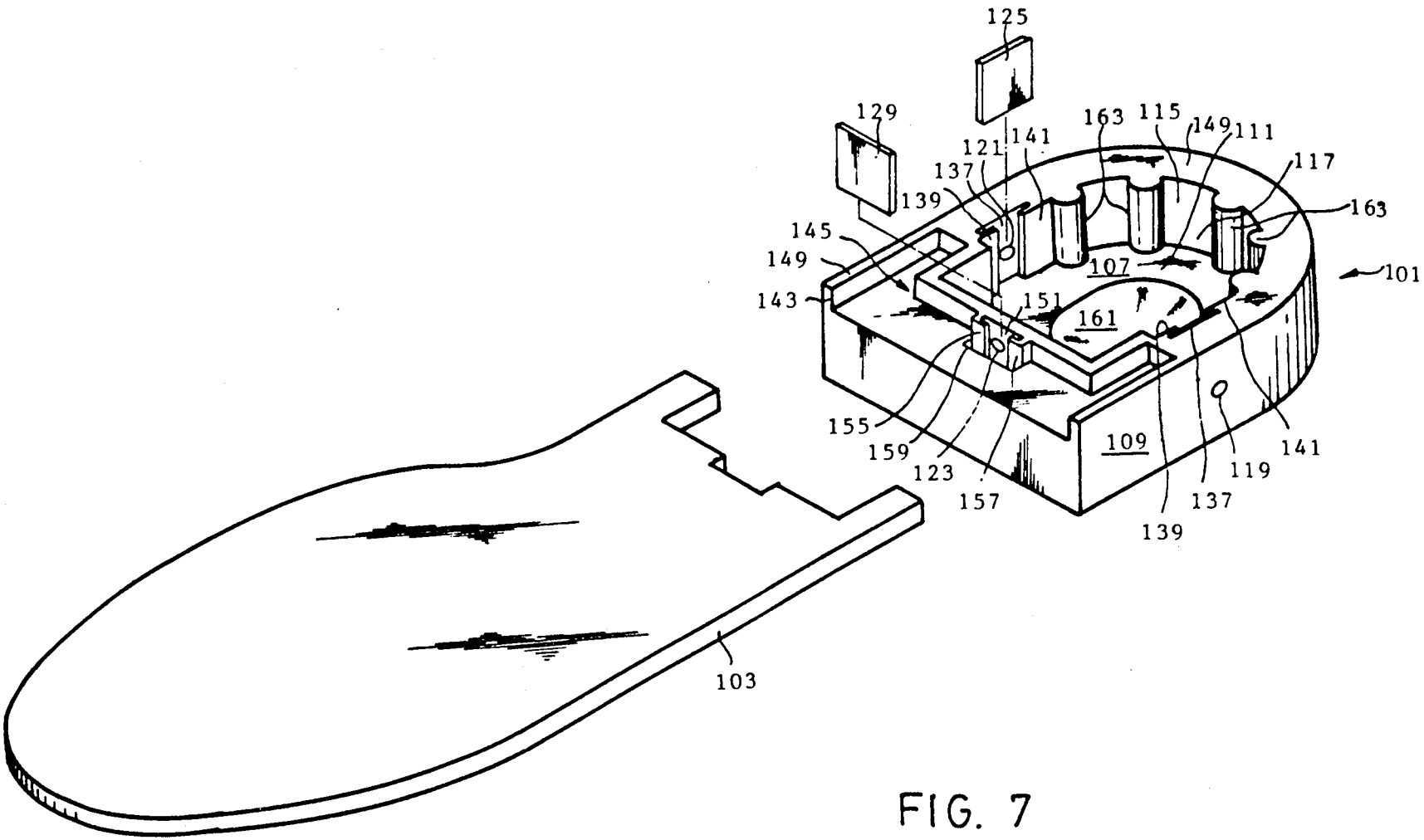
FIG. 7 is an exploded, perspective view of the bottom sole and heel of a shoe in accordance with a second embodiment of the invention.
Figure 8:
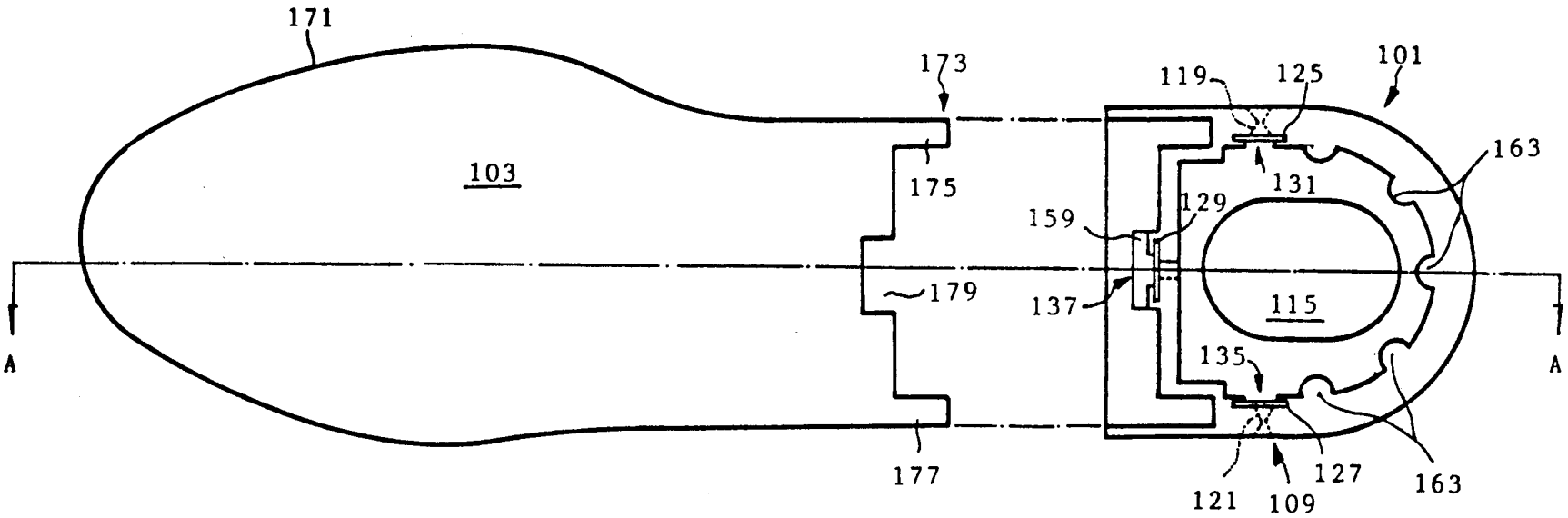
FIG. 8 is a top plan view of the shoe parts depicted in FIG. 7.
Figure 9:
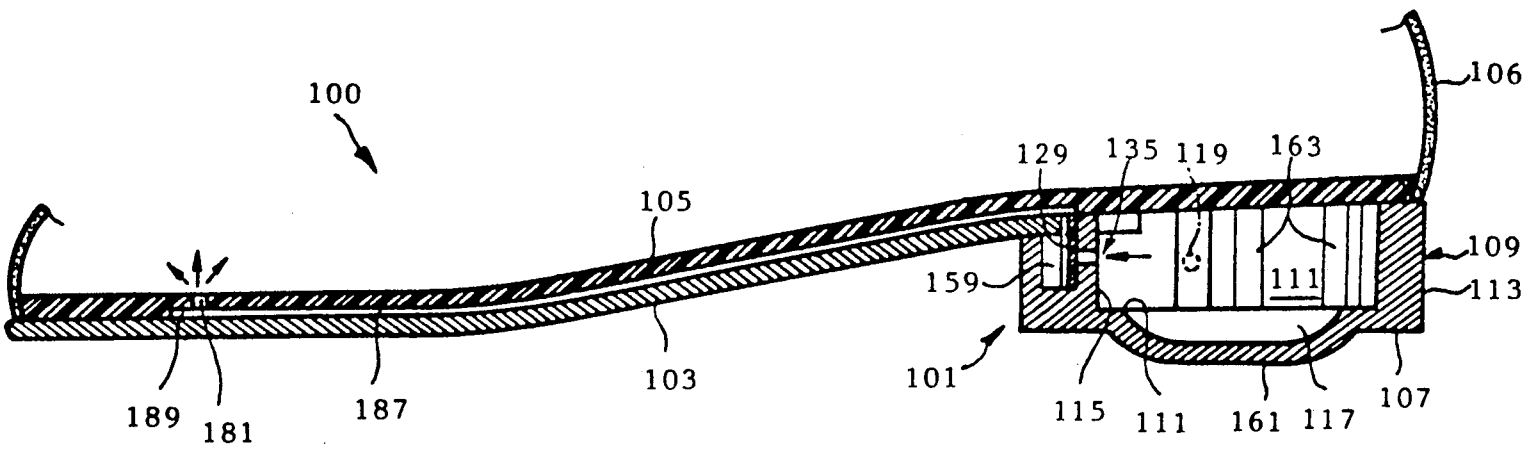
FIG. 9 is a cross sectional view taken along the center line of a shoe incorporating the present invention, such as along line 9—9 in FIG. 8.

With reference now to FIGS. 7 through 10, and in particular with reference to FIG. 9, there is depicted a shoe 100 in accordance with a second embodiment of the present invention. Shoe 100 comprises a heel 101, a lower sole 103, a middle sole 105 and a shoe upper 106 attached together with conventional means, such as stitching and adhesives. Preferably, shoe upper 106 and lower sole 103 are leather, heel 101 and middle sole 105 are man-made materials, such as a molded artificial rubber.

Referring to FIGS. 7 and 9, heel 101 is comprised of a bottom 107 and a peripheral side wall 109 that extends upwardly beyond the top surface 111 of heel 101. Side wall 109 has an outer surface 113 and an inner surface 115. Together, heel top surface 111, heel wall inner surface 115 and the bottom of middle sole 105 define a sealed cavity 117. Cavity 117 has two inlet orifices 119 and 121 and one outlet orifice 123. As seen in FIG. 8, inlet orifices 119 and 121 extend completely through the respective sides of heel wall 109 and are in the shape of an hour-glass or a converging-diverging nozzle. The nozzle shape of orifices 119 and 121 provides a means for preventing, or at least limiting, the entrance of contaminents into cavity 117. These contaminents can include dirt, debris and water.

Inlet orifices 119 and 121 and outlet orifice 123, together with valve members 125 and 127 and valve member 129, respectively, and corresponding valve member mounting means, comprise respective inlet valves 131 and 133, and an outlet valve 135 (see also FIG. 8). Valve members 125, 127 and 129 are identical and are comprised of relatively thin sheets of a flexible material having a square shape in plan view. The flexible material can be the same conventional molded rubber material that heel 101 is comprised of. The valve member mounting means of valves 131 and 133 are substantially identical, and each comprises a vertical slot 137 in heel wall 109 and spaced apart forward and rearward (as depicted in FIG. 7) flanges 139 and 141 connected along their outward ends to heel side wall inner surface 115. The valve member mounting means of outlet valve 123 includes a vertical mounting wall 143 that surrounds the periphery of an irregularly shaped depression or cavity 145 in the forward part of the upper surface of heel 101. The top surface 147 of mounting wall 143 is coplaner with the top surface 149 of heel peripheral wall 109. Outlet valve mounting means further includes a slot 151 in the forward part of mounting wall 143, and spaced apart left and right (as depicted in FIG. 7) flanges 155 and 157 connected along their outward ends to the forward surface of heel mounting wall 143. Finally, outlet valve 135 includes an outlet plenum 159 (see FIG. 9) located forward of valve member 129 and in communication at its top with cavity 145. Preferably, the components of each valve member mounting means are molded into heel wall 109.

As depicted in FIG. 9, a bulging pad 161 is mounted at the bottom surface 107 of heel 101. Bulging pad 161, as depicted in FIG. 8, has an oblong or racetrack shape in plan view. This shape provides bulging pad 161 with a greater volume of air above it and permits a more gradual compression of the air in heel cavity 117 than does bulging pad 3, FIG. 2, as the wearer of shoe 100 walks. The peripheral edges of bulging pad 161 coverage gradually upwardly (when bulging pad 161 is in the relaxed state as depicted in FIG. 9) to the points where they are fixedly mounted to heel bottom 107.

Heel 101 is also provided with a plurality of ribs 163 along the heel side wall inner surface 115 in order to provide strength and resilient support without adding too much weight. The channels between each rib 163 can be open at the top as depicted in FIG. 7 or can include a covering flange (not shown).

Lower sole 103, as shown in FIG. 8, has a conventionally shaped forward portion 171 having a size that depends upon the size of shoe 100. However, lower sole 103 has an irregularly shaped rearward portion 173 with a shape corresponding to the shape of mounting wall 143 around the rearward end of depression 145 of heel 101. Thus, rearward portion 173 has two rearwardly extending legs 175 and 177 and a centrally located cut-away portion 179. As seen in FIG. 9, sole rearward portion 173 provides an overlap that is used for mounting sole 103 to heel 101 with conventional means such as stitching, adhesive, and/or nails (not shown).

Figure 10:
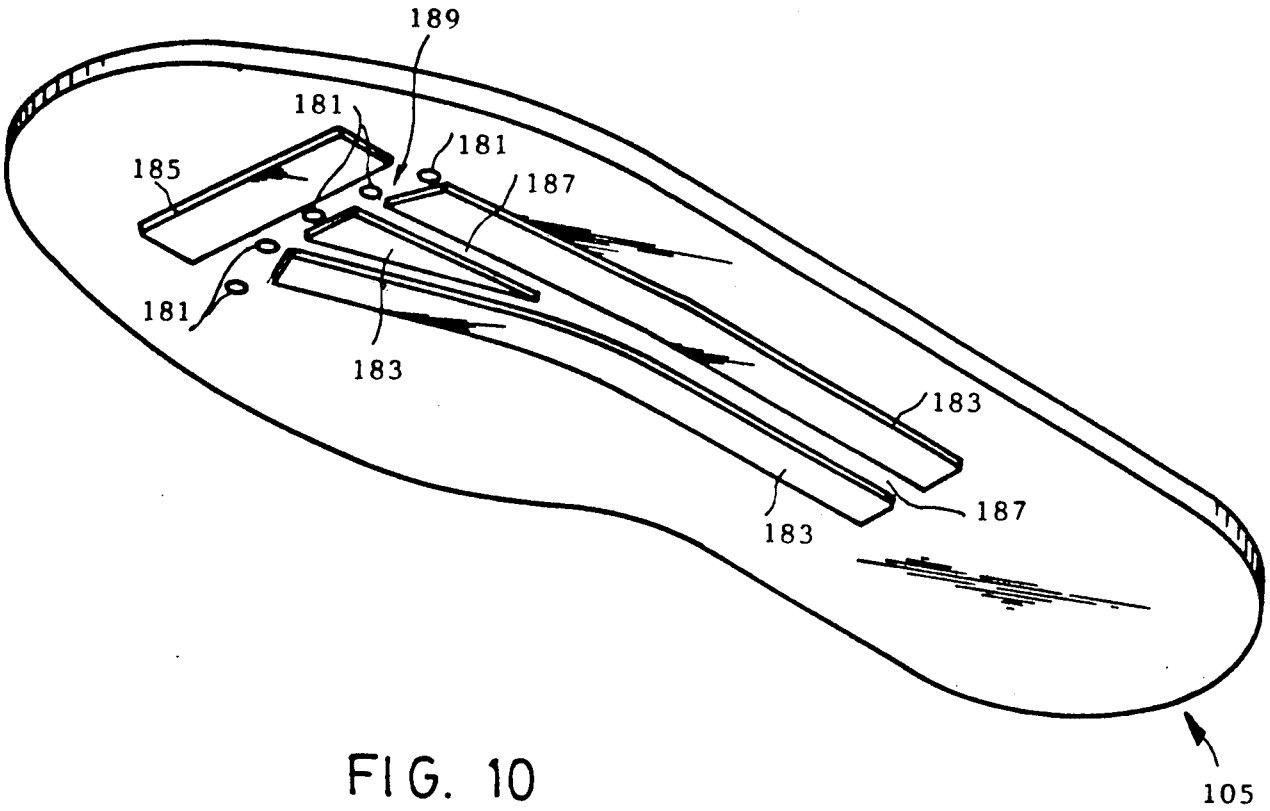
FIG. 10 is a bottom perspective view of the inner sole of the shoe depicted in FIG. 9 showing the channel members and ventilation orifices.

With reference now to FIG. 10, middle sole 105 is provided with a plurality of forwardly located orifices 181, preferably 4, 5 or 6 in number, that extend completely through middle sole 105. Orifices 181 are preferably located to correspond to the interspaces between and around the toes of the wearer of shoe 100. Mounted to the bottom surface of middle sole 105 are a plurality of elongate, longitudinally extending, mutually spaced apart, channel members 183 and transversely extending channel members 185 (only one of which is depicted in FIG. 10). Channel members 183 and 185 define a plurality of air channels or passageways 187 and 189 therebetween which are in fluid communication with outlet valve plenum 137 when the shoe components are assemblied as shown in FIG. 9. As shown in FIG. 9 in combination with FIG. 10, the top and bottom surfaces of air channels 187 and 189 are respectively defined by the bottom surface of middle sole 105 and the top surface of lower sole 103. Channel members 183 and 185 preferably extend between and are mounted along their horizontal surfaces to lower sole 103 and middle sole 105 in order to provide vertical support and resiliency to the assemblied shoe 100. Channel members 183 and 185 provide the same function as middle sole supporters 21 of shoe 5 as depicted in FIGS. 1 and 2. Although channel members 183 and 185 have been depicted in a particular configuration or pattern, other patterns can be utilized depending upon the shape and size of the shoe, the location of plenum 137, and the desired air flow.

Thus shoe 100 has been described as including an air pumping means that includes bulging pad 115, cavity 117, inlet valves 119 and 121, and outlet valve 123 and plenum 159. This air pumping means forms a shoe ventilation means when combined with air channels 187 and 189 and orifices 181 for ventilating the foot of the wearer of shoe 100.

The operation of the aforedescribed shoe ventilation means of shoe 100 is very similar to the aforedescribed operation of the corresponding means of shoe 5. When the wearer of shoe 100 places heel 101 on the ground, such as when walking, bulging pad 161 is forced upward into heel cavity 117, thereby compressing and pressurizing the air located therein. The pressure exerted by the compressed air seals shut air inlet valves 131 and 133 and opens air outlet valve 135. The pressurized air is thus forced through outlet valve 135 (as shown by the arrow in FIG. 9), into outlet plenum 159, around the perpherial wall of lower sole 103 that defines cut-away portion 179, through air channels 187 into air channel 189, and finally through orifices 181 into the interior of shoe 100.

The present invention has been described with respect to presently preferred embodiments thereof and as having the aforementioned features and advantages. Other modifications, additions and deletions of the invention would be apparent from the aforedescription and the appended drawings or obvious to one skilled in the art.

I claim:

1. A shoe having an air pumping means for supplying fresh air to the interior of the shoe, comprising:

a shoe upper having a toe portion, a mid portion and a heel portion;

a middle sole attached to and forming a bottom of said shoe upper, said middle sole having a toe portion, a mid portion and a heel portion that correspond to said portions of said shoe upper and having orifices therethrough outside of the heel portion;

a bottom sole having a toe portion, a mid portion and a heel portion that correspond to said portions of said shoe upper and said middle sole;

means for attaching said bottom sole to said middle sole in a spaced relationship therefrom, said attaching means including supporting means for defining air channels between said bottom sole and said middle sole at the toe and mid portions thereof; and a wall member defining an enclosed, sealed cavity between said middle sole and said bottom sole at the heel portions thereof;

an inlet, one-way valve in said wall member for admitting outside air into said cavity;

means in combination with said inlet valve for limiting the entrance of outside contaminants into said inlet valve, wherein said limiting means comprises an inlet orifice in fluid communication with said inlet valve and a converging-diverging flow nozzle located in said orifice;

an outlet, one-way valve in said wall member for delivering air from said cavity into said air channels; and a resilient bulging pad located in the heel portion of said bottom sole that forms at least a portion of the bottom of said cavity, said bulging pad, when in a relaxed state extending beyond said bottom sole and when in a compressed state extending into said cavity and pressurizing the air therein.

2. A shoe as claimed in claim 1 wherein said valve member has at least portions of opposite sides rectilinear and mutually parallel;

and wherein said slot has at least a portion of opposite sides rectilinear and parallel.

3. A shoe having an air pumping means for supplying fresh air to the interior of the shoe, comprising:

a shoe upper having a toe portion, a mid portion and a heel portion;

a middle sole attached to and forming a bottom of said shoe upper, said middle sole having a toe portion, a mid portion and a heel portion that correspond to said portions of said shoe upper and having orifices therethrough outside of the heel portion;

a bottom sole having a toe portion, a mid portion and a heel portion that correspond to said portions of said shoe upper and said middle sole;

means for attaching said bottom sole to said middle sole in a spaced relationship therefrom, said attaching means including supporting means for defining air channels between said bottom sole and said middle sole at the toe and mid portions thereof; and a wall member defining an enclosed, sealed cavity between said middle sole and said bottom sole at the heel portions thereof;

an inlet, one-way valve in said wall member for admitting outside air into said cavity wherein said inlet valve comprises an inlet orifice through said wall member, a removable, flexible valve member having at least portions of opposite sides rectilinear and mutually parallel, and means for positioning said valve member over said inlet orifice at the location said orifice meets with said cavity, said valve member being unattached to said wall member, said positioning means being molded into said heel and comprising spaced apart flanges connected to said wall member and extending toward each other over a portion of said wall member, said flanges and wall member portion defining a slot, said slot having at least a portion of opposite sides rectilinear and parallel and having a size such that said valve member can be removably received therein and retained by said flanges;

means in combination with said inlet valve for limiting the entrance of outside contaminants into said inlet valve;

an outlet, one-way valve in said wall member for delivering air from said cavity into said air channels; and a resilient bulging pad located in the heel portion of said bottom sole that forms at least a portion of the bottom of said cavity, said bulging pad, when in a relaxed state extending beyond said bottom sole and when in a compressed state extending into said cavity and pressurizing the air therein.

4. The shoe as claimed in claim 3 wherein said outlet valve comprises an outlet orifice through said wall member, a flexible valve member, and means for positioning said valve member over said outlet orifice at the location said orifice meets with said channel on the outside of said cavity wall, said valve member being unattached to said wall member.

5. A shoe having an air pumping means for supplying fresh air to the interior of the shoe, comprising:

a shoe upper having a toe portion, a mid portion and a heel portion;

a middle sole attached to and forming a bottom of said shoe upper, said middle sole having a toe portion, a mid portion and a heel portion that correspond to said portions of said shoe upper and having orifices therethrough outside of the heel portion;

a bottom sole having a toe portion, a mid portion and a heel portion that correspond to said portions of said shoe upper and said middle sole wherein said bottom sole comprises a heel and a sole member, and means for mounting said sole member to said heel, said sole member comprising said lower sole toe portion and said lower sole mid portion and said mounting means including arms extending rearward of said mid portion of said sole, and a correspondingly shaped cavity in said heel, and means for fixedly attaching said arms to said heel at said shaped cavity;

means for attaching said bottom sole to said middle sole in spaced relationship therefrom, said attaching means including supporting means for defining air channels between said bottom sole and said middle sole at the toe and mid portions thereof; and a wall member defining an enclosed, sealed cavity between said middle sole and said bottom sole at the heel portions thereof;

an inlet, one-way valve in said wall member for admitting outside air into said sealed cavity;

said inlet valve comprising a removable flexible valve member, and means for positioning said valve member to block said inlet channel, said valve member being unattached to said wall member, said positioning means being molded into said heel and comprising spaced apart flanges connected to said wall member and extending toward each other over a portion of said wall member, said flanges and wall member portion defining a slot, said slot having a size such that said valve member can be removably received therein and retained by said flanges;

means in combination with said inlet valve for limiting the entrance of outside contaminants into said inlet valve;

an outlet, one-way valve in said wall member for delivering air from said sealed cavity into said air channels; and a resilient bulging pad located in the heel portion of said bottom sole that forms at least a portion of the bottom of said sealed cavity, said bulging pad, when in a relaxed state extending beyond said bottom sole and when in a compressed state extending into said sealed cavity and pressurizing the air therein.

6. The shoe as claimed in claim 5 wherein said heel is a replaceable, molded heel located at said shoe upper heel portion, and at least indirectly fixedly attachable to said shoe upper, and said heel is further comprised of a bottom, said wall member and said defined cavity;

an inlet channel molded in said wall member for admitting outside air into said cavity and containing said limiting means;

said inlet valve;

said outlet valve; and said bulging pad molded in said heel bottom, and wherein the portion of said wall member located adjacent said bottom sole member defines part of said shaped cavity and receives said mounting means arms in an abutting relationship.

7. A shoe as claimed in claim 6 wherein said limiting means comprises a converging-diverging flow nozzle molded in said channel.

8. A shoe as claimed in claim 6 wherein said heel includes an outlet plenum molded in said shaped cavity, said outlet plenum providing fluid communications from the outlet of said outlet valve, past said mounting arms and to said air channels.

9. A shoe as claimed in claim 5 wherein said heel includes an outlet plenum molded in said shaped cavity, said outer plenum providing fluid communications from the outlet of said outlet valve, past said mounting arms and to said air channels.

10. A shoe as claimed in claim 5 wherein said supporting means includes a plurality of elongate channel members fixedly attached to said lower sole and said middle sole.

11. A shoe having an air pumping means for supplying fresh air to the interior of the shoe, comprising:

a shoe upper having a toe portion, a mid portion and a heel portion;

a sole attached to and forming a bottom of said shoe upper, said sole having a toe portion, a mid portion and a heel portion that correspond to said portions of said shoe upper and having air channels extending from said heel portion to said toe portion and orifices in fluid communication between said channels and the interior of said shoe upper; and a replaceable, molded heel located at said shoe upper heel portion, and at least indirectly fixedly attachable to said shoe upper, said heel comprised of a bottom, a wall member defining an enclosed, sealed cavity between said sole and said heel bottom;

an inlet channel in said wall member for admitting outside air into said cavity and including means for limiting the entrance of outside contaminants into said cavity, wherein said limiting means comprises a converging-diverging flow nozzle located in said channel;

an inlet, one-way valve in said inlet channel;

an outlet, one way valve in said wall member for delivering air from said cavity into said air channels; and a resilient bulging pad located in said heel bottom, said bulging pad, when in a relaxed state extending beyond the general plane of said heel bottom and when in a compressed state extending into said cavity and pressurizing the air therein.

12. A shoe as claimed in claim 11 wherein said valve member has at least portions of opposite sides rectilinear and mutually parallel;

and wherein said slot has at least a portion of opposite sides rectilinear and parallel.

13. A shoe having an air pumping means for supplying fresh air to the interior of the shoe, comprising:

a shoe upper having a toe portion, a mid portion and a heel portion;

a sole attached to and forming a bottom of said shoe upper, said sole having a toe portion, a mid portion and a heel portion that correspond to said portions of said shoe upper and having air channels extending from said heel portion to said toe portion and orifices in fluid communication between said channels and the interior of said shoe upper; and a replaceable, molded heel located at said shoe upper heel portion, and at least indirectly fixedly attachable to said shoe upper, said heel comprised of a bottom, a wall member defining an enclosed, sealed cavity between sole and said heel bottom;

an inlet channel in said wall member for admitting outside air into said cavity and including an inlet orifice at said cavity and means for limiting the entrance of outside contaminants into said cavity;

an inlet, one-way valve;

an outlet, one-way valve in said wall member for delivering air from said cavity into said air channels;

wherein at least one of said inlet and outlet one-way valve comprises;

a removable flexible valve member, and means for positioning said valve member, said valve member being unattached to said wall member, said positioning means being molded into said heel and comprising spaced apart flanges connected to said wall member and extending toward each other over a portion of said wall member, said flanges and wall member portion defining a slot having a size such that said valve member can be received therein and retained by said flanges; and a resilient bulging pad located in said heel bottom, said bulging pad, when in a relaxed state extending beyond the general plane of said heel bottom and when in a compressed state extending into said cavity and pressurizing the air therein.

14. A shoe as claimed in claim 13 wherein said inlet valve comprises said valve member and said positioning means and wherein said flanges and slot are molded into said heel; and wherein said valve member is positioned to block said inlet channel at said inlet orifice where said orifice meets with said cavity.

15. A shoe as claimed in claim 14 wherein said outlet valve comprises an outlet channel through said wall member at a location adjacent said bottom sole;

a removable flexible valve member, and means for positioning said valve member of said outlet valve to block said outlet channel, said valve member being unattached to said wall member, said positioning means being molded into said heel and comprising spaced apart flanges connected to said wall member and extending toward each other over a portion of said wall member, said flanges and wall member portion defining a slot having a size such that said valve member can be received therein and retained by said flanges.

16. A shoe as claimed in claim 15 wherein said outlet valve flanges and slot are molded into said heel; and wherein said valve member of said outlet valve is positioned to block said outlet channel where said channel exits said wall member adjacent said extending air channels.

17. A shoe as claimed in claim 16 wherein each of said inlet and outlet valve members has at least portions of opposite sides rectilinear and mutually parallel;

and wherein each of said inlet and outlet slots has at least a portion of opposite sides rectilinear and parallel.

18. A shoe as claimed in claim 13 wherein said valve member has at least portions of opposite sides rectilinear and mutually parallel;

and wherein said slot has at least a portion of opposite sides rectilinear and parallel.

* * * * *